US009624051B2

(12) United States Patent
Wakakusa et al.

(10) Patent No.: US 9,624,051 B2
(45) Date of Patent: Apr. 18, 2017

(54) SHEET CONVEYING APPARATUS

(71) Applicant: BROTHER KOGYO KABUSHIKI KAISHA, Nagoya-shi, Aichi-ken (JP)

(72) Inventors: Keisuke Wakakusa, Nagoya (JP); Yoichiro Nishimura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/080,952

(22) Filed: Mar. 25, 2016

(65) Prior Publication Data

US 2016/0332828 A1 Nov. 17, 2016

(30) Foreign Application Priority Data

May 11, 2015 (JP) ..... 2015-096936

(51) Int. Cl.

| | |
|---|---|
| ***B65H 1/04*** | (2006.01) |
| ***B65H 11/00*** | (2006.01) |
| ***B65H 5/26*** | (2006.01) |
| ***B65H 1/02*** | (2006.01) |

(52) U.S. Cl.

CPC ..... *B65H 1/04* (2013.01); *B65H 1/02* (2013.01); *B65H 5/26* (2013.01); *B65H 2402/441* (2013.01); *B65H 2402/46* (2013.01); *B65H 2405/324* (2013.01); *B65H 2407/21* (2013.01); *B65H 2801/12* (2013.01)

(58) Field of Classification Search

CPC ..... B65H 1/04; B65H 2405/1162; B65H 2405/11164; B65H 2405/111646; B65H 2405/1124; B65H 2405/1134; B65H 2405/1136; B65H 2405/1117; B65H 2405/324

See application file for complete search history.

(56) References Cited

U.S. PATENT DOCUMENTS

| | | | | |
|---|---|---|---|---|
| 9,254,972 | B2 * | 2/2016 | Ukai | B65H 1/04 |
| 2014/0292971 | A1 | 10/2014 | Uchino et al. | |
| 2015/0091241 | A1 | 4/2015 | Wakakusa | |

FOREIGN PATENT DOCUMENTS

| | | | |
|---|---|---|---|
| JP | 01321239 | A * | 12/1989 |
| JP | 2006062183 | A * | 3/2006 |
| JP | 2008068981 | A * | 3/2008 |
| JP | 2014-196193 | A | 10/2014 |
| JP | 2015-067401 | A | 4/2015 |

* cited by examiner

*Primary Examiner* — Luis A Gonzalez
(74) *Attorney, Agent, or Firm* — Merchant & Gould P.C.

(57) ABSTRACT

A sheet conveying apparatus includes: a main unit; a tray main body pivotable between a standing position and an inclined position; and a tray cover connected to the tray main body and pivotable between a bent position and a straight position. A space formed between the main unit and the tray main body is covered by the tray cover located at the bent position relative to the tray main body at the standing position and exposed by the tray cover located at the straight position relative to the tray main body at the inclined position. The tray cover pivoting from the straight position to the bent position relative to the tray main body at the inclined position causes the tray main body to pivot from the inclined position to the standing position, so that the tray cover covers the space.

9 Claims, 10 Drawing Sheets

SHEET CONVEYING APPARATUS

CROSS REFERENCE TO RELATED APPLICATION

The present application claims priority from Japanese Patent Application No. 2015-096936, which was filed on May 11, 2015, the disclosure of which is herein incorporated by reference in its entirety.

BACKGROUND

Technical Field

The following disclosure relates to a sheet conveying apparatus that conveys a sheet.

Description of the Related Art

Common image recording apparatuses have a conveyance path through which a sheet to be printed is conveyed. That is, the image recording apparatuses have a function as a sheet conveying apparatus. The image recording apparatuses include a main unit having such a sheet conveyance path.

There is known an image recording apparatus including a manually-placed-sheet supplier that guides a sheet to the conveyance path. The manually-placed-sheet supplier is provided on a rear surface of the main unit. The manually-placed-sheet supplier includes a tray main body for supporting a sheet on which image recording is to be performed.

When the manually-placed-sheet supplier is not to be used, the tray main body is positioned at a standing position at which the tray main body extends along the rear surface of the main unit. When the manually-placed-sheet supplier is to be used, the tray main body is positioned at an inclined position at which an upper portion of the tray main body is farther from the rear surface of the main unit than at the standing position.

The upper portion of the tray main body is provided with a tray cover that covers a space formed between the tray main body and the main unit when the manually-placed-sheet supplier is not to be used. The tray cover is pivotably supported by the upper portion of the tray main body. The tray cover is pivotable between a closed position at which the tray cover covers the space formed between the tray main body and the rear surface of the main unit and an open position at which the space is exposed to an upper side thereof.

When the sheet is supplied using the manually-placed-sheet supplier, the tray main body is positioned at the inclined position, and the tray cover is swung to the open position. As a result, the space formed between the upper portion of the tray main body and the main unit is exposed. In this state, the sheet is placed onto the tray main body located at the inclined position. The sheet placed on the tray main body is supplied to the conveyance path formed in the main unit.

SUMMARY

In the image recording apparatus described above, the tray main body is kept at the inclined position even when the tray cover is swung from the open position to the closed position in the state in which the tray main body is located at the inclined position. In this case, the tray cover cannot cover the space formed between the main unit and the tray main body in a predetermined state, which may lead to ingress of foreign matter such as dust into the space. To establish the predetermined state in which the space is covered with the tray cover, a user needs to swing the tray main body from the inclined position to the standing position. This operation may be burdensome for the user.

Accordingly, an aspect of the disclosure relates to a sheet conveying apparatus allowing a user to return a tray main body to a standing position only by returning a tray cover from an open position to a closed position when the tray main body is located at an inclined position.

In one aspect of the disclosure, a sheet conveying apparatus including: a main unit defining a conveyance path through which a sheet is to be conveyed; a tray main body configured to support the sheet to be supplied to the conveyance path, the tray main body being pivotable between a standing position and an inclined position about a first axis relative to the main unit; and a tray cover connected to the tray main body and pivotable about a second axis parallel with the first axis, relative to the tray main body, between a bent position at which the tray cover is bent relative to the tray main body and a straight position at which the tray cover extends straight relative to the tray main body. A space formed between the main unit and the tray main body is covered by the tray cover located at the bent position relative to the tray main body at the standing position and exposed by the tray cover located at the straight position relative to the tray main body at the inclined position. The tray cover pivoting from the straight position to the bent position relative to the tray main body at the inclined position causes the tray main body to pivot from the inclined position to the standing position, so that the tray cover covers the space.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described a multi-function peripheral (MFP) 10 (as one example of a sheet conveying apparatus) according to one embodiment by reference to the drawings. It is to be understood that the following embodiment is described only by way of example, and the disclosure may be otherwise embodied with various modifications without departing from the scope and spirit of the disclosure.

Overall Construction of MFP

Figure 1:
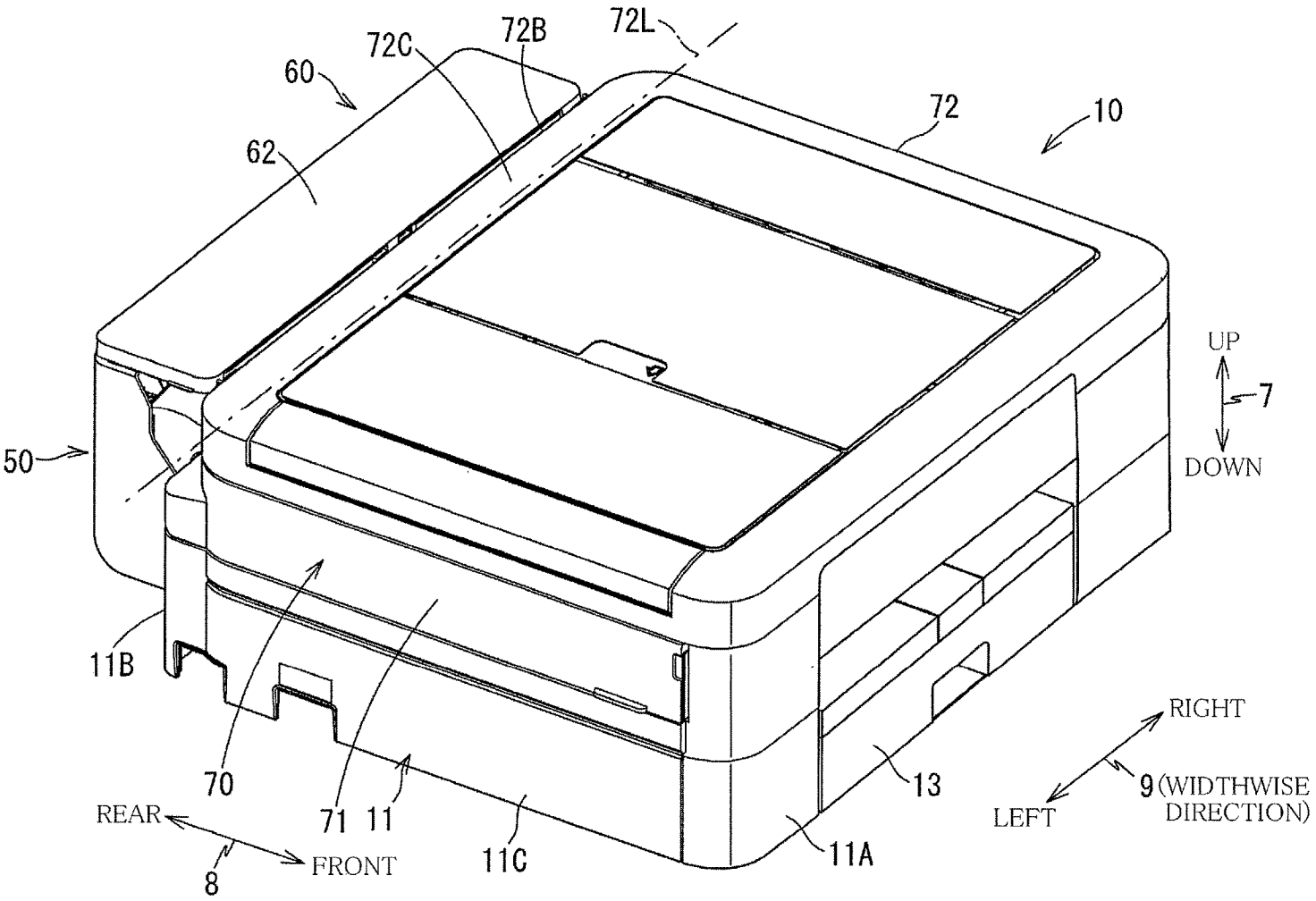
FIG. 1 is an external perspective view of a multi-function peripheral (MFP)

The MFP 10 illustrated in FIG. 1 has various functions such as a printing function, a scanning function, and a facsimile function. The MFP 10 is used in a state illustrated in FIG. 1. In the present embodiment, arrows illustrated in FIG. 1 indicate an up and down direction 7, a front and rear direction 8, and a right and left direction 9. These directions are defined with respect to a state of the MFP 10 illustrated in FIG. 1, i.e., the MFP 10 being in a normal state. In this state, the right and left direction 9 coincides with the widthwise direction of the MFP 10 which may be hereinafter referred to as "widthwise direction 9".

The MFP 10 includes a main unit 11 capable of performing printing, and a scanner unit 70 provided on the main unit 11. A rear surface 11B of the main unit 11 is provided with a bypass tray 60.

The MFP 10 includes a supply tray 13 mounted on a lower portion of the main unit 11. The supply tray 13 is mountable on and removable from the main unit 11. The supply tray 13 can store sheets on which images are to be recorded. The main unit 11 records an image on a sheet supplied from the supply tray 13. The bypass tray 60 supports sheets different from the sheets contained in the supply tray 13. The main unit 11 is capable of recording an image on a sheet supplied from the bypass tray 60. It is noted that a sheet supply from the bypass tray 60 may be hereinafter referred to as "manually-placed-sheet supply". The scanner unit 70 is used for obtaining image data representative of a document.

Figure 2:
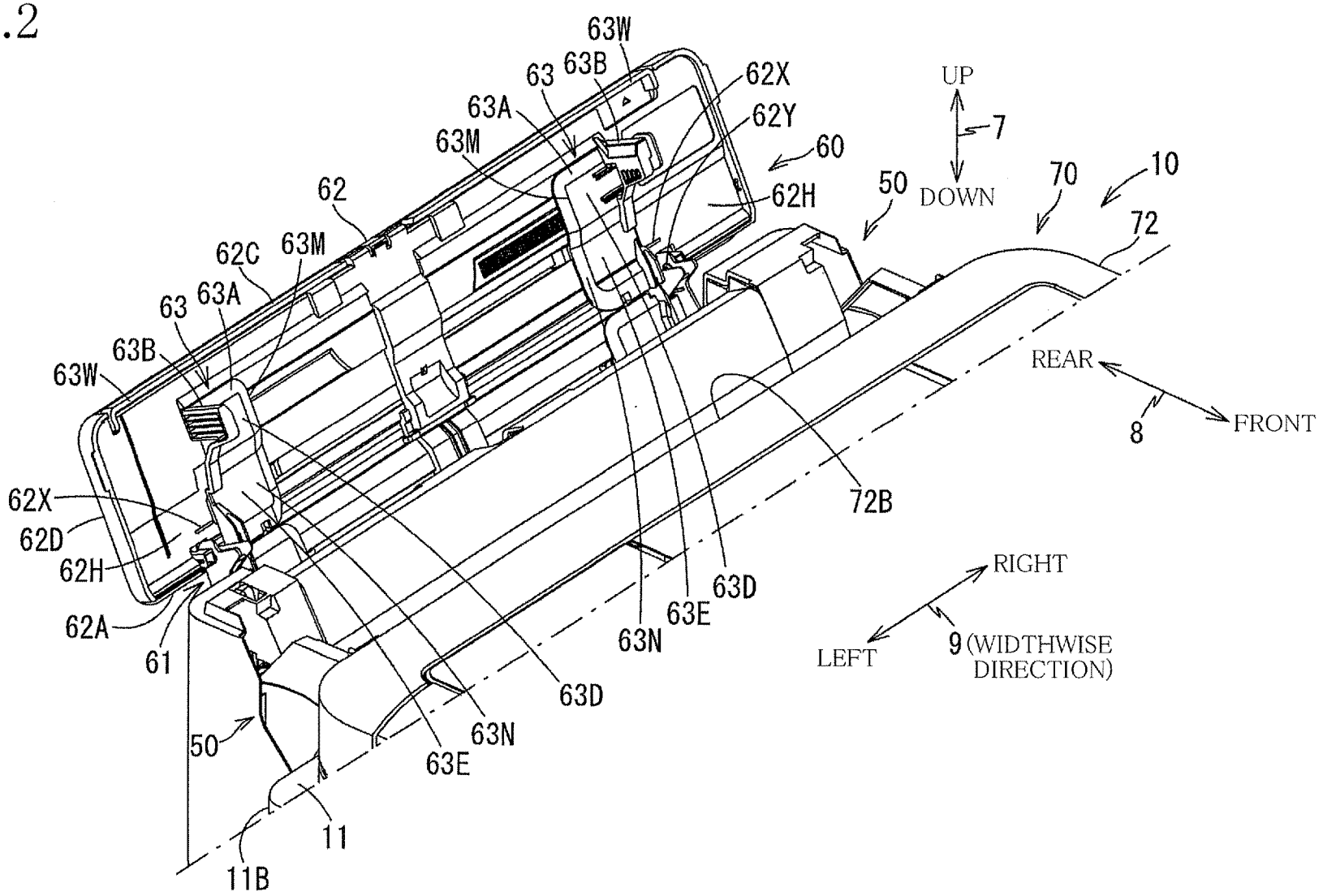
FIG. 2 is a perspective view of a rear portion of the MFP when manually-placed-sheet supply is performed.

The bypass tray 60 is in a state illustrated in FIG. 1 when the manually-placed-sheet supply is not to be executed. The bypass tray 60 is in a state illustrated in FIG. 2 when the manually-placed-sheet supply is to be performed. As illustrated in FIG. 2, the bypass tray 60 is supported by a tray supporter 50 supported at right and left ends of the rear surface 11B of the main unit 11. The bypass tray 60 will be described later in detail.

Main Unit 11

Figure 3:
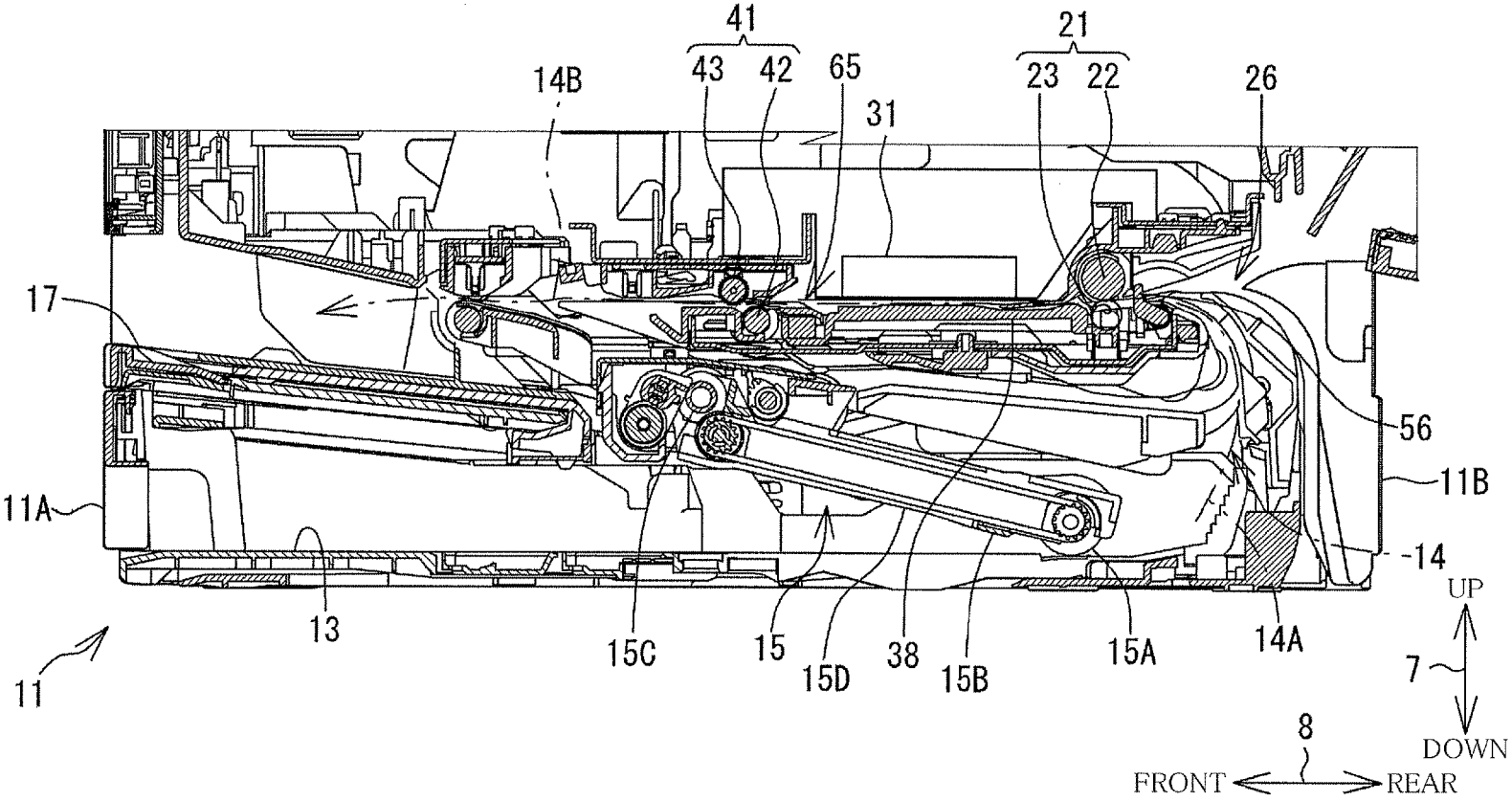
FIG. 3 is an elevational view in vertical cross section illustrating an internal structure of a main unit.

As illustrated in FIG. 3, a conveyance path 14 is defined in the main unit 11. Each sheet supplied from the supply tray 13 is conveyed along the conveyance path 14. An image recorder 31 is provided in an upper portion of the main unit 11. The image recorder 31 is an ink-jet recording device configured to record an image on the sheet conveyed along the conveyance path 14. A platen 38 is provided under the image recorder 31 to support each sheet on which an image is to be recorded by the image recorder 31.

The conveyance path 14 has a first conveyance path 14A for guiding each sheet upward from the supply tray 13 in a rear portion of the main unit 11. The conveyance path 14 has a second conveyance path 14B continued from the first conveyance path 14A. The second conveyance path 14B linearly guides the sheet frontward from the rear portion of the main unit 11. The second conveyance path 14B extends between the image recorder 31 and the platen 38. The sheet placed on the bypass tray 60 is also supplied to the second conveyance path 14B.

The main unit 11 includes a sheet supplier 15 configured to supply each sheet from the supply tray 13 to the first conveyance path 14A of the conveyance path 14. The sheet supplier 15 includes a support arm 15B disposed on the supply tray 13. A front end portion of the support arm 15B is supported by a support shaft 15C extending in the widthwise direction 9. A rear end portion of the support arm 15B supports a supply roller 15A rotatably provided so as to extend in the widthwise direction 9.

When the support arm 15B is swung about the support shaft 15C such that the rear end portion of the support arm 15B is moved downward, the supply roller 15A is brought into contact with the uppermost one of the sheets in the supply tray 13. When the support arm 15B is swung about the support shaft 15C such that the rear end portion of the support arm 15B is moved upward, the supply roller 15A is moved away from the uppermost sheet. The supply roller 15A is rotated in a particular direction by power that is transmitted from a motor, not illustrated, by a power transmitting mechanism 15D. The uppermost sheet in the supply tray 13 is supplied into the first conveyance path 14A of the conveyance path 14 by the supply roller 15A being rotated.

A first roller pair 21 is provided between the first conveyance path 14A and the second conveyance path 14B. The first roller pair 21 conveys the sheet from the first conveyance path 14A to the second conveyance path 14B. The first roller pair 21 includes: one first conveying roller 22 that contacts an upper surface of the sheet; and a plurality of pinch rollers 23 that contact a lower surface of the sheet. In a state in which the pinch rollers 23 are in contact with the first conveying roller 22, the pinch rollers 23 are rotated by rotation of the first conveying roller 22. When the sheet is conveyed to the first conveying roller 22 and the pinch rollers 23 being rotated, the sheet is nipped between the first conveying roller 22 and the pinch rollers 23 and conveyed onto the platen 38.

Figure 4:
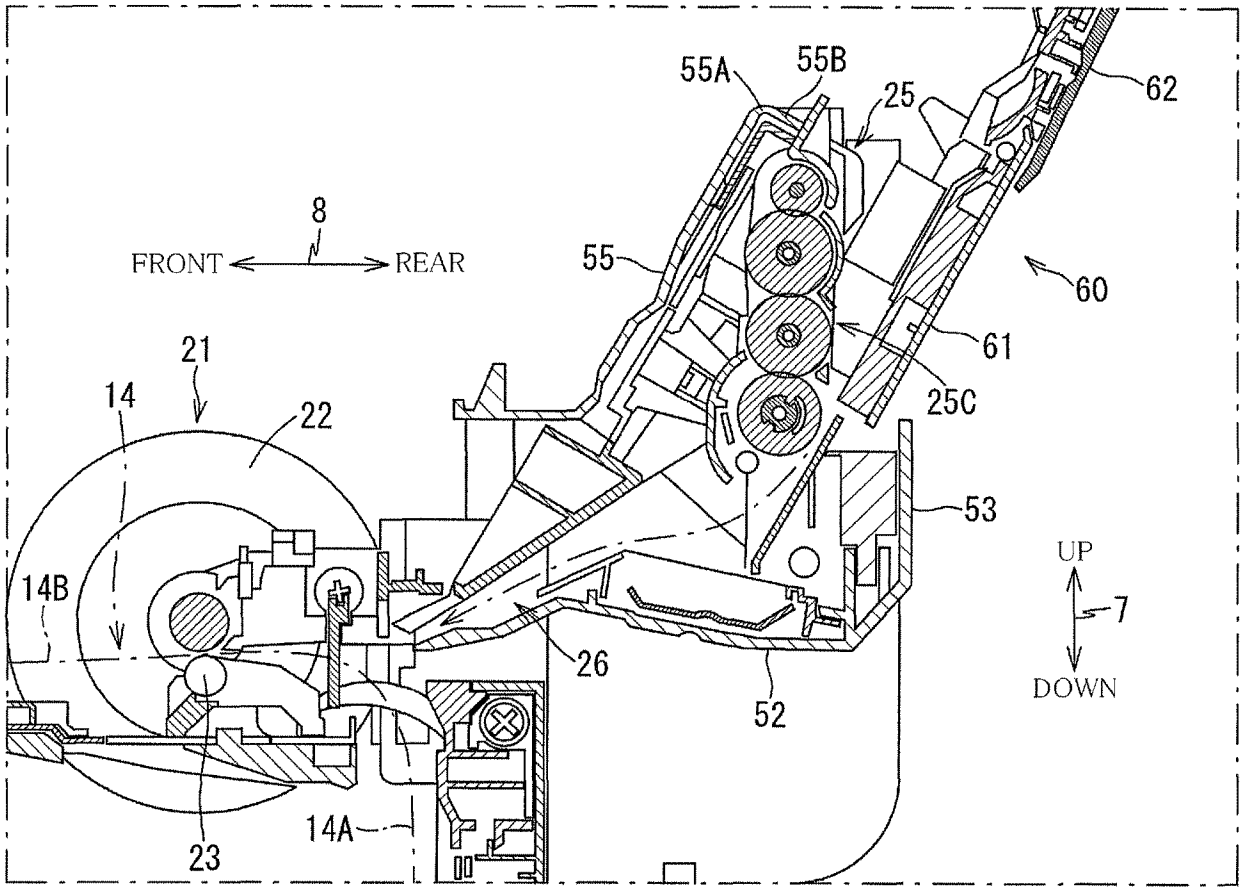
FIG. 4 is a cross-sectional view of the rear portion of the MFP when the manually-placed-sheet supply is performed.

An insertion opening 26 is formed behind the first roller pair 21. The sheet is supplied from the bypass tray 60 through this insertion opening 26. As illustrated in FIG. 4, a bypass sheet supplier 25 is provided behind and above the insertion opening 26. The bypass sheet supplier 25 supplies the sheet from the bypass tray 60 to the first roller pair 21. The construction of the bypass sheet supplier 25 will be described later.

As illustrated in FIG. 3, a second roller pair 41 is provided downstream of the platen 38 in a sheet conveying direction. The second roller pair 41 includes a plurality of second conveying rollers 42 arranged under the second conveyance path 14B, and a plurality of spur rollers 43 arranged over the second conveying rollers 42. Each of the spur rollers 43 is protruded and recessed alternately in its circumferential direction. The spur rollers 43 are movable between a position at which the spur rollers 43 are spaced apart from the second conveying rollers 42 and a position at which the spur rollers 43 are held in contact with the respective second conveying rollers 42. In the state in which the spur rollers 43 are in contact with the second conveying rollers 42, the spur rollers 43 are rotated by rotation of the second conveying rollers 42. When the sheet is conveyed to the second conveying rollers 42 and the spur rollers 43 being rotated, the sheet is nipped between the second conveying rollers 42 and the spur rollers 43 and discharged onto a sheet-output tray 17. The sheet-output tray 17 is disposed over the supply tray 13.

Scanner Unit 70

As illustrated in FIG. 1, the scanner unit 70 is a flatbed scanner that includes: a scanner body 71 provided on the main unit 11; and a document cover 72 (as one example of a pivoting unit) disposed on the scanner body 71. A rear portion of the document cover 72 is located on a rear portion of the scanner body 71. The rear portion of the document cover 72 and the rear portion of the scanner body 71 are coupled to each other such that the document cover 72 is pivotable about an axis 72L (as one example of a third axis) extending in the widthwise direction 9. A front end portion of the document cover 72 is a free end portion that is moved in the up and down direction 7 when the document cover 72 is swung about the axis 72L.

Figure 5:
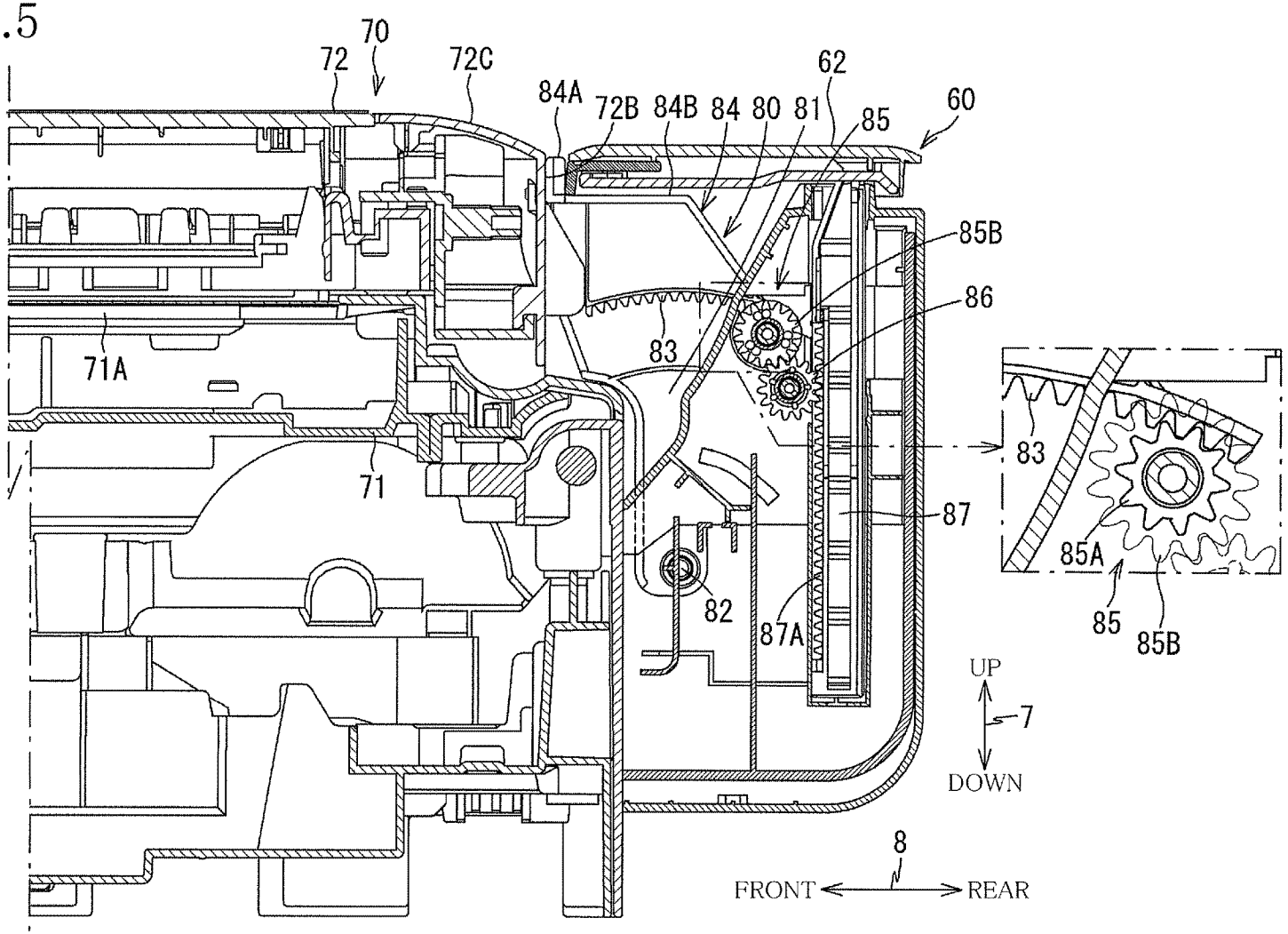
FIG. 5 is a cross-sectional view of the rear portion of the MFP with a document cover located at a first position when the manually-placed-sheet supply is not performed.

As illustrated in FIG. 5, a platen glass 71A for supporting a document is provided on an upper surface of the scanner body 71. A document is to be placed on the platen glass 71A. The scanner body 71 contains an image sensor, not illustrated, capable of optically reading an image formed on the document placed on the platen glass 71A.

When the platen glass 71A is covered with the document cover 72, the document cover 72 is located at a first position. When the document cover 72 is swung 90 degrees from the first position such that the free end portion of the document cover 72 is moved upward, the document cover 72 is positioned at a second position.

The document cover 72 is provided with an automatic document feeder (ADF), not illustrated, that picks up and conveys documents one by one for image recording. A well-known ADF is employed for this MFP 1, and a detailed explanation of which is dispensed with.

Bypass Sheet Supplier 25 of Main Unit 11

Figure 6:
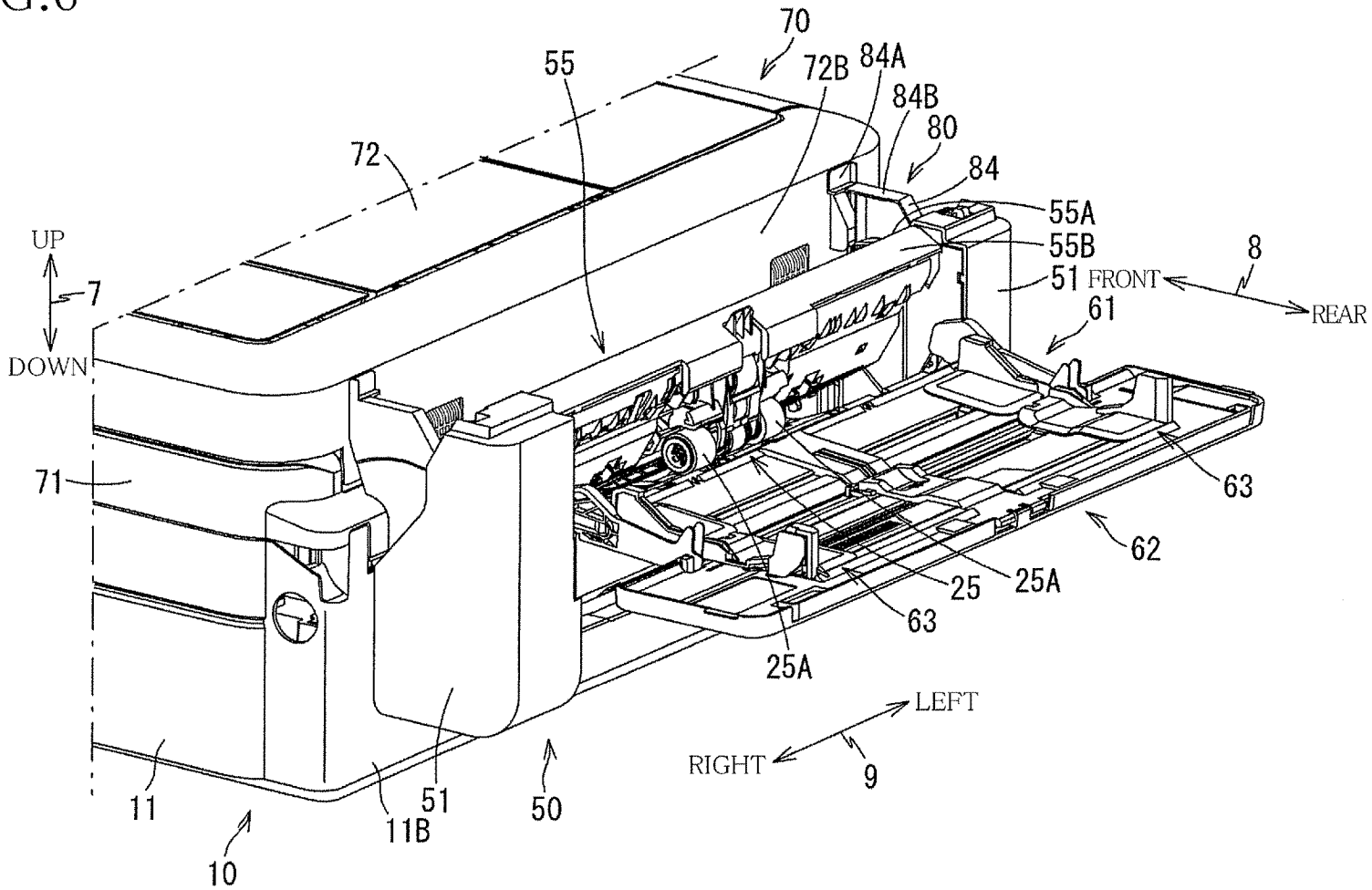
FIG. 6 is a perspective view of the rear portion of the MFP when a tray main body of a bypass tray is in a horizontal state.

As illustrated in FIG. 6, the bypass sheet supplier 25 provided on the rear portion of the main unit 11 includes bypass rollers 25A disposed at a central portion of the main unit 11 in the widthwise direction 9. The bypass rollers 25A are rotated by power that is transmitted via a power transmitting mechanism 25C illustrated in FIG. 4.

As illustrated in FIG. 4, a bypass cover 55 is provided in front of the power transmitting mechanism 25C. The bypass cover 55 covers a front portion of the power transmitting mechanism 25C. The bypass cover 55 is supported by the tray supporter 50 which will be described below. The bypass cover 55 will be described later in detail.

Tray Supporter 50 of Main Unit 11.

Figure 7:
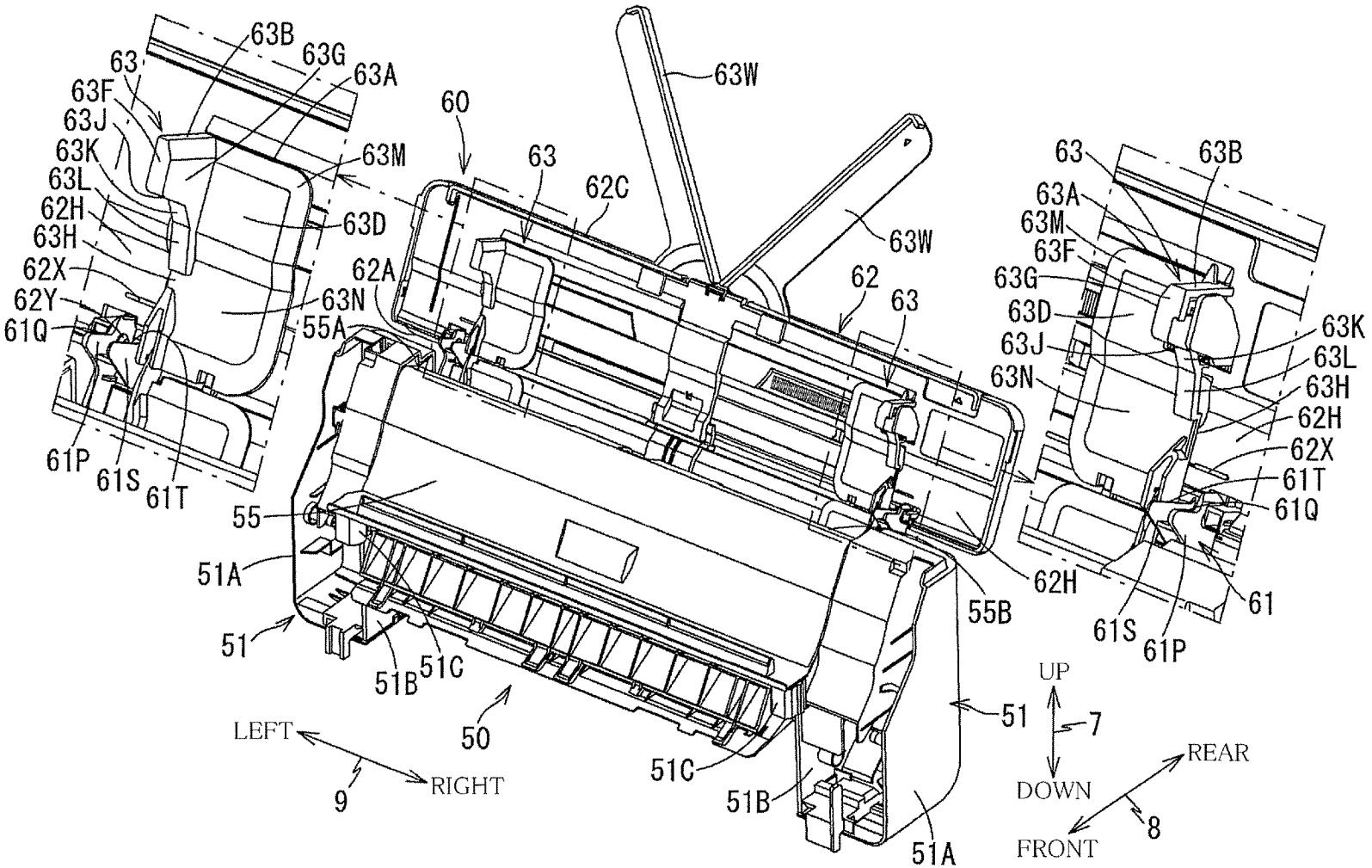
FIG. 7 is perspective view for explaining constructions of a tray supporter and a bypass tray.
Figure 8:
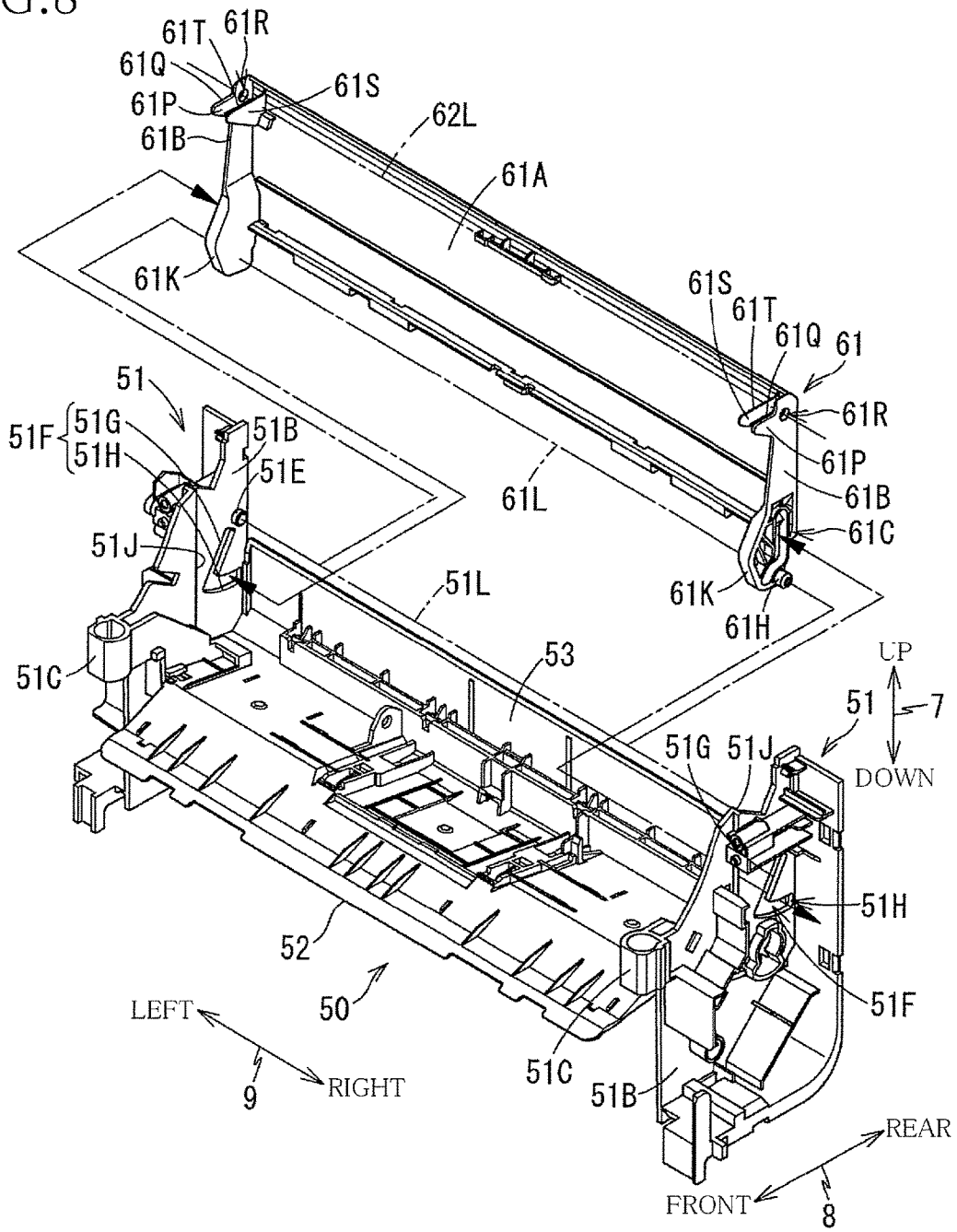
FIG. 8 is a perspective view of the tray supporter and the tray main body of the bypass tray which are separated from each other.

As illustrated in FIG. 7, the tray supporter 50 provided on the rear portion of the main unit 11 has right and left side walls 51 in the widthwise direction 9. The side walls 51 respectively support lower portions of opposite end portions of the bypass cover 55 in the widthwise direction 9. The bypass cover 55 is provided so as to extend between the side walls 51. As illustrated in FIG. 8, a lower guide plate 52 and a rear plate 53 are provided between the side walls 51. A lower portion of a tray main body 61 of the bypass tray 60 is located on a rear portion of the lower guide plate 52. A tray cover 62 illustrated in FIG. 7 is supported on an upper portion of the tray main body 61.

As illustrated in FIG. 6, an interlock mechanism 80 is provided on the left side wall 51 of the main unit 11 in the widthwise direction 9. With this interlock mechanism 80, the pivotal movement of the document cover 72 of the scanner unit 70 and the pivotal movement of the tray cover 62 provided on the bypass tray 60 are performed in conjunction with each other. The interlock mechanism 80 will be described later in detail.

As illustrated in FIG. 7, each of the side walls 51 has an outer side wall cover 51A in the widthwise direction 9. The side wall cover 51A is shaped like a plate elongated in the up and down direction 7 and disposed along the front and rear direction 8. Each of the side walls 51 has an inner side surface 51B disposed parallel with the side wall cover 51A at a position nearer to the center of the main unit 11 than the side wall cover 51A in the widthwise direction 9. As illustrated in FIG. 8, a rear portion of the side surface 51B is located outside a front portion of the side surface 51B in the widthwise direction 9. A step 51J extending along the up and down direction 7 is formed between the front portion and the rear portion of the side surface 51B.

A cover supporter 51C is provided on a front edge of the side surface 51B at a central portion thereof in the up and down direction 7. The cover supporter 51C supports a lower end portion of the bypass cover 55 at a corresponding one of opposite ends of the bypass cover 55 in the widthwise direction 9. As illustrated in FIG. 8, each cover supporter 51C has a cylindrical shape and is disposed such that the axial direction of the cover supporter 51C extends along the up and down direction 7. Supporters, not illustrated, are provided respectively on the opposite ends of the lower end portion of the bypass cover 55 in the widthwise direction 9. These supporters are fitted in the respective cover supporters 51C.

As illustrated in FIG. 4, the bypass cover 55 is inclined such that its upper end portion is located at a rear of its lower end portion. The upper end portion of the bypass cover 55 is provided with a curved surface 55A that protrudes upward in an arc shape. An upper surface 55B extending rearward is continued from the curved surface 55A. The upper surface 55B is inclined downward. The bypass cover 55 is one example of a second member, and the curved surface 55A is one example of a second sliding contact surface.

As illustrated in FIG. 8, the lower guide plate 52 and the rear plate 53 are constituted integrally with each other. The lower guide plate 52 has a planar plate shape. The lower guide plate 52 is disposed so as to extend in the widthwise direction 9 substantially at the same height corresponding to that of central portions of the respective side surfaces 51B in the up and down direction 7. The rear plate 53 also has a planar plate shape and extends upward from a rear end portion of the lower guide plate 52. As illustrated in FIG. 4, a front end portion of the lower guide plate 52 is located under the insertion opening 26. An upper end of the rear plate 53 extends at the same height corresponding to that of a central portion of the rear portion of the side surface 51B in the up and down direction 7.

As illustrated in FIG. 8, the left side surface 51B of the main unit 11 in the widthwise direction 9 is provided with a first shaft 51E that protrudes inward at a position above the upper end of the rear plate 53. Though not illustrated, the right side surface 51B of the main unit 11 in the widthwise direction 9 is provided with a first shaft 51E similar in construction to the first shaft 51E provided on the left side surface 51B. The first shafts 51E each having a circular cylinder shape are arranged coaxially with each other. The axis of each first shaft 51E coincides with a straight first axis 51L.

Each of the side walls 51 has a guide groove 51F formed under the corresponding first shaft 51E. As will be described below, the tray main body 61 of the bypass tray 60 is provided with guide shafts 61H. These guide shafts 61H are slidably fitted in the respective guide grooves 51F. Each of the guide grooves 51F has a first guide 51G and a second guide 51H. The first guide 51G is inclined such that its lower end portion is located in front of its upper end portion. The second guide 51H extends rearward from the lower end portion of the first guide 51G. The upper end portion of the first guide 51G is located near the first shaft 51E. The second guide 51H is shaped like an arc that is curved along a circumference of a circle centered about the first shaft 51E.

Bypass Tray 60

The bypass tray 60 includes the tray main body 61 illustrated in FIG. 8 and the tray cover 62 (see FIG. 7) supported on the upper portion of the tray main body 61. As illustrated in FIG. 8, the tray main body 61 is disposed between the side walls 51 of the tray supporter 50.

The tray main body 61 includes: a sheet supporter 61A having a planar plate shape and disposed so as to extend in the widthwise direction 9; and tray side members 61B respectively formed on opposite ends of the sheet supporter 61A in the widthwise direction 9. The sheet supporter 61A is disposed between the side walls 51 of the tray supporter 50. The tray side members 61B are opposed to the side surfaces 51B of the respective side walls 51 of the tray supporter 50.

The tray side members 61B each shaped like a plate respectively extend along opposite edges of the sheet supporter 61A in the widthwise direction 9. The tray side members 61B protrude frontward from the sheet supporter 61A. A lower portion of each of the tray side members 61B has a contact portion 61K protruding frontward in an arc shape. When the tray main body 61 is located at an inclined position, the contact portion 61K is in contact with the step 51J provided on a corresponding one of the side surfaces 51B of the tray supporter 50.

Figure 10:
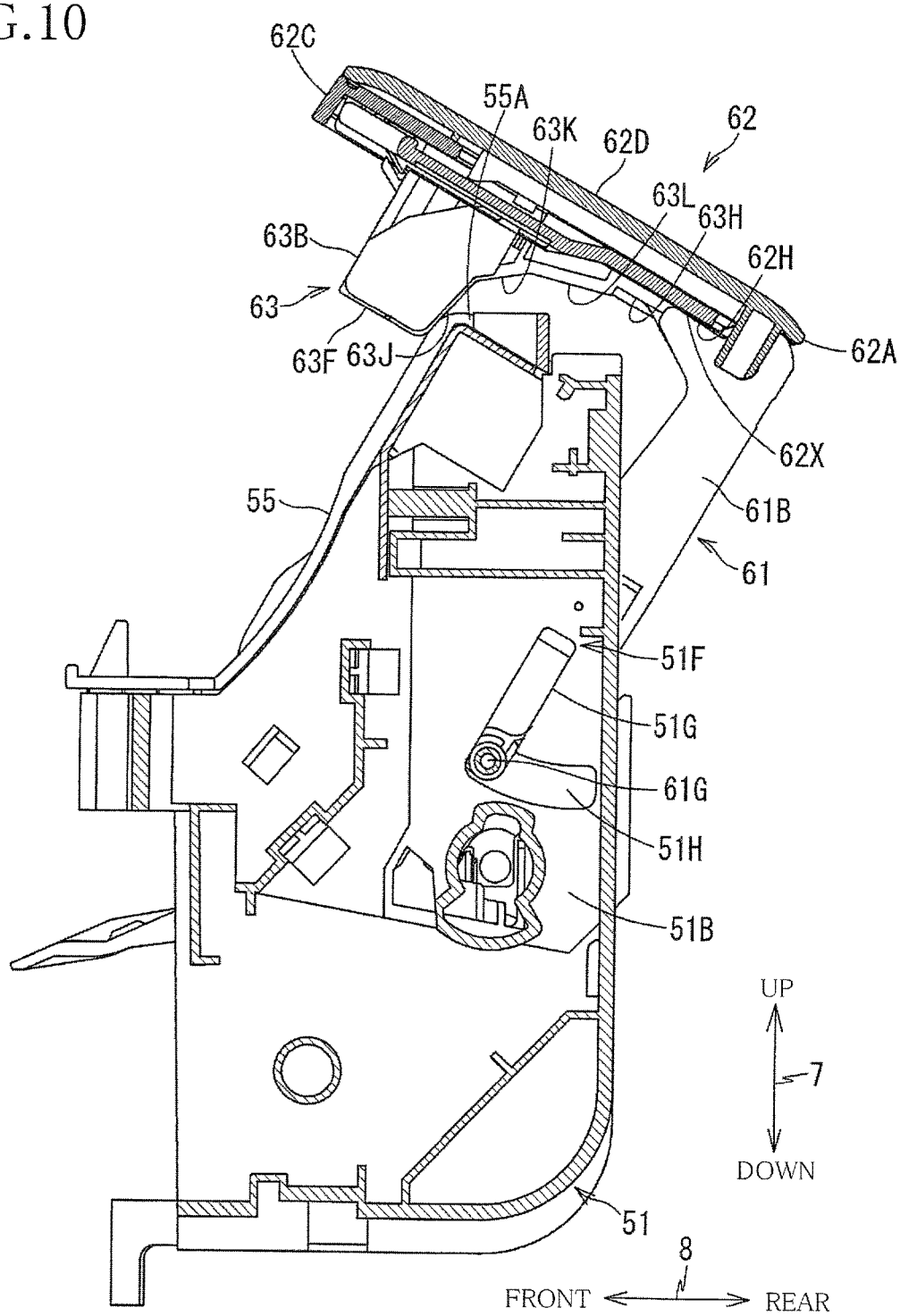
FIG. 10 is a cross-sectional view of the bypass tray when a tray cover swings from an open position to a closed position, with the tray main body located at an inclined position.

A lower end of each of the tray side members 61B is located below a lower end of the sheet supporter 61A. A lower end portion of each of the tray side members 61B is provided with the guide shaft 61H protruding outward. The guide shafts 61H each having a circular cylindrical shape are arranged coaxially with each other. The axis of each guide shaft 61H coincides with a straight line 61L. As illustrated in FIG. 10, the guide shafts 61H are slidably inserted in the guide grooves 51F formed in the respective side surfaces 51B of the tray supporter 50.

Figure 9B:
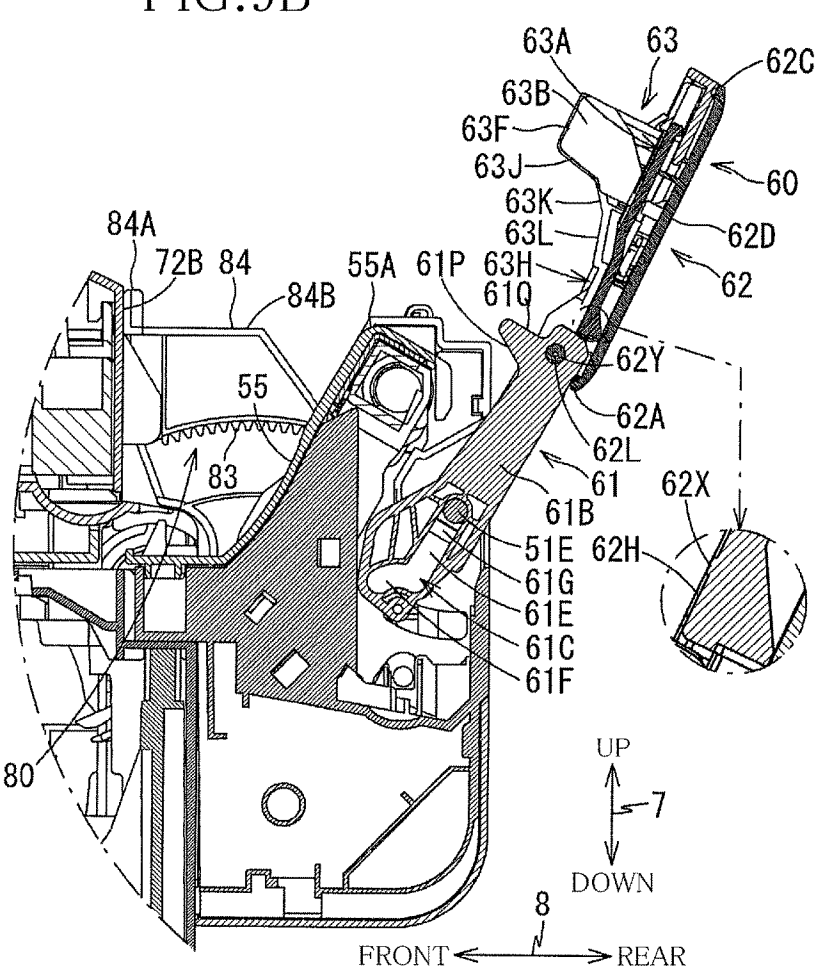
FIG. 9B is a cross-sectional view of the bypass tray when the manually-placed-sheet supply is performed.
Figure 9A:
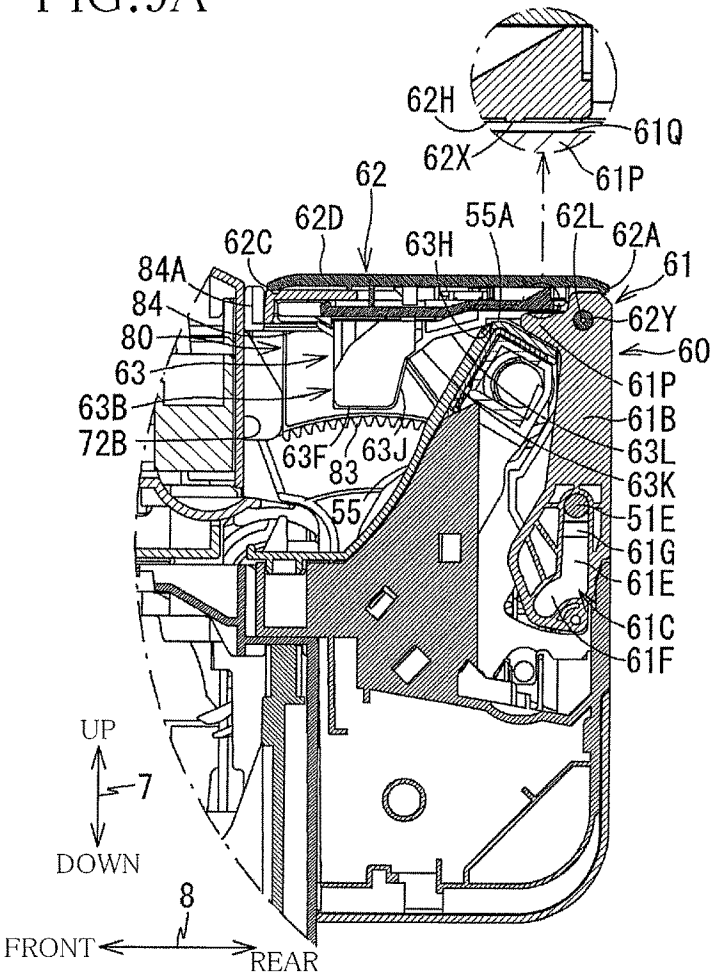
FIG. 9A is a cross-sectional view of the bypass tray when the manually-placed-sheet supply is not performed.

As illustrated in FIG. 8, slide grooves 61C (one of which is not illustrated in FIG. 8) are formed in lower portions of the respective tray side members 61B facing outward in the widthwise direction 9. Each of the slide grooves 61C receives the first shaft 51E provided on a corresponding one of the side surfaces 51B of the tray supporter 50. As illustrated in FIGS. 9A and 9B, each slide groove 61C has a first groove 61E and a second groove 61F. The first groove 61E extends straight along the longitudinal direction of a corresponding one of the tray side members 61B. The second groove 61F extends frontward from a lower end portion of the first groove 61E. The second groove 61F is shaped like an arc that is curved along a circumference of a circle centered about the guide shaft 61H.

A partition 61G is provided in an upper portion of the first groove 61E to partition an upper end portion of the first groove 61E. The partition 61G is disposed so as to form a space in the upper end portion of the first groove 61E such that the first shaft 51E is turnably fitted in the space. The partition 61G protrudes outward in the widthwise direction 9. When the sheet supporter 61A is slid away from the second groove 61F along the first groove 61E, the first shaft 51E fitted in the space formed in the upper end portion of the first groove 61E is moved over the partition 61G.

The tray main body 61 is pivotable about the first axis 51L (see FIG. 8) of the first shafts 51E fitted in the spaces of the respective first grooves 61E. When the tray main body 61 is swung in a direction in which its upper portion is moved toward the rear surface 11B of the main unit 11, i.e., frontward, the tray main body 61 is positioned at a standing position at which the tray main body 61 extends along the rear surface 11B. When the tray main body 61 is located at the standing position, a space is formed between the sheet supporter 61A and the rear surface 11B of the main unit 11.

When the tray main body 61 is swung such that an upper portion of the sheet supporter 61A is moved away from the rear surface 11B of the main unit 11, the guide shafts 61H are brought into contact with portions of the tray supporter 50 which define the second guides 51H of the respective guide grooves 51F. Also, the contact portions 61K provided on the lower portions of the respective tray side members 61B are brought into contact with the steps 51J provided on the respective side surfaces 51B of the tray supporter 50. As a result, the sheet supporter 61A is stopped at the inclined position at which the tray main body 61 is inclined at a particular angle. In the case where the tray main body 61 is located at the inclined position, as will be described below, when the tray cover 62 is moved to an open position, a user can place a sheet onto the inclined sheet supporter 61A.

When the tray main body 61 is positioned at the inclined position, the guide shafts 61H provided on the tray main body 61 are located in the second guides 51H of the guide grooves 51F provided on the respective side surfaces 51B of the tray supporter 50. Thus, when the tray main body 61 is swung about the first axis 51L of the first shafts 51E, the guide shafts 61H are slid along the respective second guides 51H. This configuration enables the tray main body 61 to be smoothly swung about the first axis 51L of the first shafts 51E. When the tray main body 61 is positioned at the inclined position, each guide shaft 61H is located at the lower end portion of the corresponding first guide 51G which is a frontmost portion of the second guide 51H of the guide groove 51F.

When the sheet supporter 61A located at the inclined position is slid upward along its inclination direction, as described above, each first shaft 51E fitted in the space formed in the upper end portion of the first groove 61E is moved over the corresponding partition 61G. In this case, the first shaft 51E is slid toward the second groove 61F along the first groove 61E.

When the first shafts 51E are slid, each guide shaft 61H is slid upward in the first guide 51G of the guide groove 51F from its lower end portion. When the guide shaft 61H reaches the upper end portion of the first guide 51G the first shaft 51E is positioned at the lower end portion of the first groove 61E of the slide groove 61C.

As a result, the guide shafts 61H are disengaged from the portions of the tray supporter 50 which define the second guides 51H of the respective guide grooves 51F. Also, the contact portions 61K of the respective tray side members 61B are disengaged from the respective steps 51J of the tray supporter 50. In this state, the first shafts 51E are slidable in the second grooves 61F of the respective slide grooves 61C. As a result, the weight of the tray main body 61 applies a force to the tray main body 61 such that the upper portion of the tray main body 61 pivots downward about the guide shaft 61H. This force swings the upper portion of the tray main body 61 downward, and the first shafts 51E are slid in the second grooves 61F of the respective slide grooves 61C. When the tray main body 61 becomes a substantially horizontal, the tray main body 61 is brought into contact with the upper end of the rear plate 53 of the tray supporter 50. As a result, the tray main body 61 is stopped in the horizontal state as illustrated in FIG. 6.

As illustrated in FIG. 8, an upper portion of each of the tray side members 61B of the tray main body 61 is provided with a protrusion 61P that protrudes frontward when the tray main body 61 is located at the standing position. An upper surface 61Q of the protrusion 61P extends in a direction perpendicular to the sheet supporter 61A. Each of the tray side members 61B has a round through hole 61R at its upper portion. The through holes 61R are formed coaxially, and the axis of the through holes 61R coincides with a straight second axis 62L. As will be described below, second shafts 62Y provided, as pivot shafts, on the tray cover 62 (see FIGS. 9A and 9B) are fitted in the respective through holes 61R.

In the state illustrated in FIG. 8, projections 61S are provided on the upper portion of the sheet supporter 61A. The projections 61S protrude frontward in parallel with the protrusions 61P. Each of the projections 61S is provided nearer to the center of the sheet supporter 61A than a corresponding one of the protrusions 61P in the widthwise direction 9. Each projection 61S is provided near the corresponding protrusion 61P so as to be opposed to the protrusion 61P. Each projection 61S has an upper surface 61T that is parallel with the upper surface 61Q of the corresponding protrusion 61P in a state in which the upper surface 61T and the upper surface 61Q are located at the same height.

As illustrated in FIG. 7, the tray cover 62 supported by the tray main body 61 is shaped like a plate and disposed in state in which the longitudinal direction of the tray cover 62 coincides with the widthwise direction 9. The tray cover 62 has opposite edges, namely, a side edge 62A (hereinafter may be referred to as "first side edge 62A") and a side edge 62C (hereinafter may be referred to as "second side edge 62C"), each extending in the longitudinal direction of the tray cover 62. The tray cover 62 is disposed such that this first side edge 62A extends along an upper edge of the sheet supporter 61A of the tray main body 61, and the second side edge 62C is located near a rear surface 72B of the document cover 72. The tray cover 62 is pivotable such that the second side edge 62C located near the rear surface 72B of the document cover 72 is moved upward and rearward.

As illustrated in FIG. 9A, the tray cover 62 is in its horizontal state when the second side edge 62C of the tray cover 62 is located near the rear surface 72B of the document cover 72. An upper surface of the tray cover 62 in this state is defined as a surface 62D. The entire surface 62D is substantially flat. As illustrated in FIG. 9A, the tray cover 62 has flat portions 62H facing downward in the horizontal state of the tray cover 62.

As illustrated in FIG. 2, a second shaft 62Y is provided at the right flat portion 62H in the widthwise direction 9. As illustrated in FIG. 7, a second shaft 62Y is provided at the left flat portion 62H in the widthwise direction 9. The second shafts 62Y are provided over the respective tray side members 61B of the tray main body 61. The second shafts 62Y are turnably inserted in the through holes 61R formed in the upper portions of the respective tray side members 61B.

The second shafts 62Y each having a circular cylindrical shape are arranged coaxially with each other. As illustrated in FIG. 8, the axis of the second shafts 62Y coincides with the second axis 62L coinciding with the axis of the through holes 61R. The tray cover 62 is pivotable about the second axis 62L relative to the tray main body 61 between a bent position at which the tray cover 62 is bent relative to the tray main body 61 and a straight position at which the tray cover 62 extends straight relative to the tray main body 61.

In the case where the tray main body 61 is located at the standing position along the rear surface 11B of the main unit 11, when the tray cover 62 becomes horizontal, the tray cover 62 covers a space between the rear surface 11B of the main unit 11 and the upper portion of the sheet supporter 61A of the tray main body 61. This position of the tray cover 62 may be hereinafter referred to as "closed position" (see FIG. 9A). When the tray cover 62 located at the closed position is swung so as to move the second side edge 62C upward, the tray cover 62 does not cover the space between the rear surface 11B of the main unit 11 and the upper portion of the sheet supporter 61A, in other words, the space is exposed. The tray cover 62 is pivotable to a state in which the tray cover 62 extends along the sheet supporter 61A. In the following description, the position of the tray cover 62 extending along the sheet supporter 61A is defined as the open position (see FIG. 9B).

In the case where the tray main body 61 is located at the inclined position, and the tray cover 62 is located at the open position, when a sheet is supported on the sheet supporter 61A, an upper portion (trailing end portion) of the sheet is supported on the tray cover 62.

As illustrated in FIG. 7, the tray cover 62 is provided with two guide members 63 that respectively guide outer edges of the sheet in the widthwise direction 9 when the sheet supported on the sheet supporter 61A is supplied into the main unit 11. The guide members 63 are arranged on the respective flat portions 62H of the tray cover 62. The guide members 63 protrude from the flat portions 62H in a direction opposite to a direction in which the surface 62D is exposed. The guide members 63 are operated in an interlocked fashion by a rack and pinion mechanism, not illustrated, so as to be movable toward and away from each other.

Each of the guide members 63 includes: a base 63A shaped like a planar plate on which sheets are to be placed; and a protrusion 63B protruding from the base 63A in a direction away from the surface 62D of the tray cover 62. The base 63A is disposed along a direction perpendicular to the longitudinal direction of the tray cover 62. The base 63A has a first portion 63M located near the second side edge 62C, and a second portion 63N located near the first side edge 62A. The first portion 63M has a flat sheet support surface 63D for supporting the sheets. A surface of the second portion 63N is located nearer to the surface 62D of the tray cover 62 than the sheet support surface 63D.

Each of the protrusions 63B is disposed along the front and rear direction 8 perpendicular to the longitudinal direction of the tray cover 62. Surfaces of the protrusions 63B which are opposed to each other in the widthwise direction 9 are guide surfaces 63G for respectively guiding opposite edges of the sheets in the widthwise direction 9. When the protrusions 63B are moved toward each other in an interlocked fashion, the sheets supported on the sheet support surface 63D are aligned by the guide surfaces 63G with respect to the center of the main unit 11 in the widthwise direction 9. When the aligned sheets are supplied by the bypass sheet supplier 25 into the main unit 11 one by one, the opposite edges of the sheets in the widthwise direction 9 are guided by the guide surfaces 63G of the respective protrusions 63B.

As illustrated in FIGS. 9A and 9B, each of the protrusions 63B has a distal end 63F at which an amount of protrusion of the protrusion 63B from the first portion 63M is the largest. The distal end 63F has a flat surface at its portion spaced apart from the first portion 63M at the largest distance, and the flat surface is parallel with the sheet support surface 63D. A first inclined surface 63J continued from the distal end 63F extends obliquely toward the first side edge 62A. The first inclined surface 63J is inclined with respect to the sheet support surface 63D by a relatively large angle, e.g., about 80 degrees.

The first inclined surface 63J is continued to a second inclined surface 63K that extends obliquely toward the first side edge 62A. The angle of inclination of the second inclined surface 63K with respect to the sheet support surface 63D is less than that of the first inclined surface 63J, for example, the angle of inclination of the second inclined surface 63K is about 30 degrees.

The second inclined surface 63K is continued to a third inclined surface 63L that extends obliquely toward the first side edge 62A. The angle of inclination of the third inclined surface 63L with respect to the sheet support surface 63D is less than that of the second inclined surface 63K, for example, the angle of inclination of the third inclined surface 63L is about 10 degrees. The protrusion 63B is one example of a first member. Each of the first inclined surface 63J, the second inclined surface 63K, and the third inclined surface 63L is one example of a first sliding contact surface.

A recessed engaging portion 63H is formed on an opposite side of the third inclined surface 63L from the second inclined surface 63K. As illustrated in FIG. 9A, when the tray main body 61 is located at the standing position, and the tray cover 62 is located at the closed position, the curved surface 55A provided on the upper end portion of the bypass cover 55 is engaged with the engaging portion 63H. The engaging portion 63H is spaced apart from the first side edge 62A.

When the tray cover 62 is swung to the closed position as illustrated in FIG. 10 in the state in which the tray main body 61 is located at the inclined position as illustrated in FIG. 9B, the first inclined surfaces 63J of the respective protrusions 63B are brought into contact with the curved surface 55A provided on the upper end portion of the bypass cover 55. The weight of the tray cover 62 acts on the curved surface 55A at positions at which the first inclined surfaces 63J are held in contact with the curved surface 55A. As a result, a reaction force from the curved surface 55A acts on the first inclined surfaces 63J in a radial direction of the curved surface 55A.

The reaction force acting on the first inclined surfaces 63J contains a component force (i.e., a horizontal component force) directed toward the rear surface 11B of the main unit 11. This horizontal component force continues to act on the first inclined surfaces 63J while the first inclined surfaces 63J are held in sliding contact with the curved surface 55A. As a result, the entire tray cover 62 is moved frontward toward the rear surface 11B of the main unit 11. When the entire tray cover 62 is moved frontward, the tray main body 61 is swung following the tray cover 62 such that the upper portion of the sheet supporter 61A of the tray main body 61 is moved frontward.

When the entire first inclined surfaces 63J are held in sliding contact with the curved surface 55A, the second inclined surfaces 63K are brought into sliding contact with the curved surface 55A continuously from the first inclined surfaces 63J. Also in this case, a reaction force from the curved surface 55A acts on the second inclined surfaces 63K. A horizontal component force contained in the reaction force from the curved surface 55A moves the tray cover 62 toward the rear surface 11B of the main unit 11. As a result, the tray main body 61 is swung such that the upper portion of the sheet supporter 61A is moved frontward.

When the entire second inclined surfaces 63K are brought into contact with the curved surface 55A, the third inclined surfaces 63L are brought into contact with the curved surface 55A continuously from the second inclined surfaces 63K. Also in this case, a horizontal component force contained in the reaction force from the curved surface 55A moves the entire tray cover 62 toward the rear surface 11B of the main unit 11. As a result, the tray main body 61 is swung such that the upper portion of the sheet supporter 61A is moved frontward.

As described above, when the first inclined surfaces 63J are brought into sliding contact with the curved surface 55A, the first inclined surfaces 63J, the second inclined surfaces 63K, and the third inclined surfaces 63L are continuously brought into sliding contact with the curved surface 55A. As a result, the tray main body 61 is swung continuously such that the upper portion of the sheet supporter 61A is moved upward and frontward.

When the entire third inclined surfaces 63L are brought into sliding contact with the curved surface 55A, the engaging portions 63H provided continuously from the third inclined surfaces 63L are engaged with the curved surface 55A. As a result, the movement of the tray cover 62 relative to the curved surface 55A is stopped. Thus, the pivotal movement of the tray main body 61, i.e., the movement of the upper portion of the sheet supporter 61A is stopped. As a result, the tray main body 61 is positioned at the standing position.

In this case, the angle of inclination of the second inclined surfaces 63K with respect to the sheet support surface 63D is less than that of the first inclined surfaces 63J. Thus, the horizontal component force contained in the reaction force from the curved surface 55A is less in the case where the second inclined surfaces 63K are held in sliding contact with the curved surface 55A than in the case where the first inclined surfaces 63J are held in sliding contact with the curved surface 55A. Accordingly, the speed of the movement of the tray cover 62 toward the rear surface 11B of the main unit 11 is less in the case where the second inclined surfaces 63K are held in sliding contact with the curved surface 55A than in the case where the first inclined surfaces 63J are held in sliding contact with the curved surface 55A.

The angle of inclination of the third inclined surfaces 63L with respect to the sheet support surface 63D is less than that of the second inclined surfaces 63K. Thus, the speed of the movement of the tray cover 62 toward the rear surface 11B of the main unit 11 is much less in the case where the third inclined surfaces 63L are held in sliding contact with the curved surface 55A than in the case where the second inclined surfaces 63K are held in sliding contact with the curved surface 55A.

As illustrated in FIG. 7, contact ribs 62X (each as one example of a contact portion) each extending in the widthwise direction 9 are provided on the respective flat portions 62H near the first side edge 62A. That is, the contact ribs 62X are provided nearer to the second axis 62L about which the tray cover 62 is pivotable, than the center of gravity of the tray cover 62. Each of the contact ribs 62X is disposed corresponding to the protrusion 61P and the projection 61S provided on the upper portion of a corresponding one of the tray side members 61B of the tray main body 61. Each of the contact ribs 62X protrudes from the flat portion 62H at the same height. When the tray cover 62 is swung from the open position to the closed position, each of the contact ribs 62X is brought into contact with the upper surface 61Q of the corresponding protrusion 61P and the upper surface 61T of the corresponding projection 61S.

As illustrated in FIG. 10, when the tray cover 62 is swung from the open position to the closed position in the state in which the tray main body 61 is located at the inclined position, each contact rib 62X is brought into contact with the upper surface 61Q of the corresponding protrusion 61P and the upper surface 61T of the corresponding projection 61S. As a result, a moment is generated on the tray cover 62 due to its own weight with respect to a position at which each contact rib 62X is brought into contact with the upper surface 61Q of the corresponding protrusion 61P and the upper surface 61T of the corresponding projection 61S. That is, the position serves as a fulcrum for the moment. In this case, the center of gravity of the tray cover 62 is located nearer to the second side edge 62C than the contact ribs 62X about which the moments are generated. Thus, an upward moment acts on the first side edge 62A of the tray cover 62 about the contact ribs 62X. This moment contains a moment that swings the tray main body 61 about the first shaft 51E so as to move the upper portion of the tray main body 61 frontward.

A moment acts on the upper portion of the tray main body 61 due to gravity about the first shaft 51E in a direction opposite to a direction of the moment that swings the tray main body 61 so as to move its upper portion toward the rear surface 11B of the main unit 11. However, the moment acting on the upper portion of the tray main body 61 for moving the upper portion toward the rear surface 11B of the main unit 11 is greater than the moment acting on the upper portion of the tray main body 61 for moving the upper portion away from the rear surface 11B of the main unit 11. Thus, the upper portion of the tray main body 61 is reliably moved frontward.

As illustrated in FIG. 7, two subsidiary arms 63W are provided on the tray cover 62. The subsidiary arms 63W are swung upward from the tray cover 62 from a state in which the subsidiary arms 63W are accommodated in the tray cover 62 as illustrated in FIG. 2. As a result, a state illustrated in FIG. 7 is established. The subsidiary arms 63W in this state supports the sheets placed on the tray main body 61 and the tray cover 62 located at the open position.

Interlock Mechanism 80

As illustrated in FIG. 5, the interlock mechanism 80 includes a pivot member 81 disposed along the side wall 51 disposed on the left end portion of the tray supporter 50 in the widthwise direction 9. The pivot member 81 has a planar plate shape elongated in the up and down direction 7 and is disposed between the side wall cover 51A and the side surface 51B. A lower portion of the pivot member 81 is pivotably supported by a pivot shaft 82 disposed along the widthwise direction 9. An upper portion of the pivot member 81 is pivotable in the front and rear direction 8.

The upper portion of the pivot member 81 is provided with a segment gear 83 formed integrally with the pivot member 81. The segment gear 83 is constituted by a portion of an internal gear and is disposed along a circumference of a circle centered about the pivot shaft 82. The segment gear 83 pivots in the front and rear direction 8 together with the pivot member 81.

As illustrated in FIG. 9B, a gear cover 84 is provided for covering the segment gear 83. The gear cover 84 has an upper surface 84B disposed along the front and rear direction 8 over the segment gear 83. A front end portion of the upper surface 84B is located in front of the segment gear 83 and provided with a sliding contact member 84A extending upward. When the document cover 72 of the scanner unit 70 is located at the first position, the sliding contact member 84A is located at a rear of the rear surface 72B of the document cover 72. The sliding contact member 84A is in contact with an upper portion of the rear surface 72B of the document cover 72 located at the first position, in a state in which the pivot member 81 is located at its most frontward position (in a direction toward the rear surface 11B of the main unit 11).

When the document cover 72 is swung from the first position to the second position, the sliding contact member 84A is brought into sliding contact with the rear surface 72B of the document cover 72 in accordance with the pivotal movement of the document cover 72. In this operation, the upper portion of the rear surface 72B of the document cover 72 is inclined rearward from a state in which the rear surface 72 extends along the up and down direction 7. With the inclining movement of the rear surface 72B of the document cover 72, the sliding contact member 84A is swung rearward. When the document cover 72 is further swung toward the second position, the sliding contact member 84A is brought into contact with an upper surface 72C of the document cover 72, from the state in which the sliding contact member 84A is in contact with the rear surface 72B of the document cover 72. The sliding contact member 84A is swung rearward with the movement of the upper surface 72C of the document cover 72 toward the inclined state. When the sliding contact member 84A is swung rearward, the pivot member 81 is swung rearward about the pivot shaft 82.

As illustrated in FIG. 5, an idler gear 85 is provided under a rear portion of the segment gear 83. The idler gear 85 includes a first gear 85A (see the enlarged view in FIG. 5) meshed with the segment gear 83, and a second gear 85B rotated together with the first gear 85A. The second gear 85B is disposed coaxially with the first gear 85A. A pinion gear 86 meshed with the second gear 85B is provided under the idler gear 85.

A slide member 87 is provided at a rear of the pinion gear 86. The slide member 87 has a rod shape extending in the up and down direction 7. The slide member 87 is located at a rear portion of the tray supporter 50. A rack gear 87A meshed with the pinion gear 86 is formed in a front surface of the slide member 87. An upper end portion of the slide member 87 is opposed to a rear portion of a left end portion of the tray cover 62 located at the closed position.

When the segment gear 83 is swung rearward together with the pivot member 81, the first gear 85A of the idler gear 85 meshed with the segment gear 83 is rotated. The second gear 85B of the idler gear 85 is also rotated together, which rotates the pinion gear 86. In this case, the rack gear 87A meshed with the pinion gear 86 is moved upward, so that the entire slide member 87 is slid upward.

The slide member 87 is located at its lowest position when the document cover 72 is located at the first position, and the pivot member 81 is not swung rearward. In this state, the upper end portion of the slide member 87 is in contact with or located near the rear portion of the left end portion of the tray cover 62.

When the document cover 72 is swung in this state so as to be moved from the first position to the second position, the slide member 87 is slid upward. As a result, the tray cover 62 is pressed so as to be moved upward, and the tray cover 62 located at the closed position is swung such that the second side edge 62C located near the rear surface 72B of the document cover 72 is moved upward. In the state in which the second side edge 62C of the tray cover 62 has been moved upward and rearward, the rear surface 72B of the document cover 72 does not contact the second side edge 62C of the tray cover 62 when the document cover 72 is swung from the first position to the second position. This construction enables the document cover 72 to be smoothly swung to the second position.

Operations of Bypass Tray 60

When the manually-placed-sheet supply is not to be performed, the bypass tray 60 is in the state illustrated in FIG. 1. In this state, the tray main body 61 is located at the standing position so as to extend along the rear surface 11B of the main unit 11, and the tray cover 62 is located at the closed position for covering the space between the tray main body 61 and the main unit 11. When located at the closed position, the tray cover 62 prevents ingress of foreign matter such as dust into the space defined by the tray main body 61 and the main unit 11.

When the manually-placed-sheet supply is to be performed, the tray cover 62 is positioned at the open position, and the tray main body 61 is positioned at the inclined position. In this state, as illustrated in FIG. 9B, the tray cover 62 extends along the sheet supporter 61A of the tray main body 61. The user places the sheets onto the sheet supporter 61A of the tray main body 61 located at the inclined position. The sheets placed on the sheet supporter 61A are also supported on the sheet support surfaces 63D of the respective guide members 63 of the tray cover 62. In this case, the subsidiary arms 63W are taken out from the tray cover 62 to support the sheets when needed.

The sheet placed on the sheet supporter 61A is supplied by the bypass sheet supplier 25 to the second conveyance path 14B of the conveyance path 14 formed in the main unit 11. The image recorder 31 records an image on the sheet conveyed along the second conveyance path 14B.

When the manually-placed-sheet supply is finished, the user moves the tray cover 62 from the open position to a position at which the tray cover 62 is pivotable due to its own weight. In this state, the tray cover 62 swings to the closed position by its own weight.

The curved surface 55A is brought into sliding contact with the first inclined surfaces 63J, the second inclined surfaces 63K, and the third inclined surfaces 63L in order, and the second inclined surfaces 63K is less than the first inclined surfaces 63J in angle of inclination with respect to the sheet support surface 63D, and the third inclined surfaces 63L is less than the second inclined surfaces 63K in angle of inclination with respect to the sheet support surface 63D. With this construction, the speed of movement of the tray main body 61 is gradually reduced when the tray main body 61 is swung from the inclined position to the standing position. Accordingly, the tray main body 61 is smoothly moved to the standing position.

The first inclined surfaces 63J, the second inclined surfaces 63K, the third inclined surfaces 63L of the protrusions 63B provided on the respective guide members 63 are continuously brought into sliding contact, in this order, with the curved surface 55A provided on the upper end portion of the bypass cover 55. As a result, the tray cover 62 is moved toward the rear surface 11B of the main unit 11, thereby moving the tray main body 61 to the standing position. Thereafter, the engaging portions 63H provided on the guide members 63 are engaged with the curved surface 55A.

Effects

In the present embodiment, when the tray cover 62 is swung to the closed position by its own weight, the protrusions 63B are brought into sliding contact with the bypass cover 55, so that the tray main body 61 is positioned at the standing position. The tray cover 62 located at the closed position covers the space between the main unit 11 and the tray main body 61 located at the standing position. Thus, the tray cover 62 prevents ingress of foreign matter such as dust into the space.

The tray cover 62 has the sheet support surface 63D that supports the sheets with the tray main body 61 when the tray cover 62 is located at the open position with respect to the tray main body 61 located at the inclined position. With this construction, the sheets placed by the user is stably supported by the tray main body 61 located at the inclined position and the sheet support surface 63D of the tray cover 62 located at the open position.

The bypass cover 55 has the curved surface 55A protruding in the arc shape. The protrusions 63B of the respective guide members 63 provided on the tray cover 62 have the first inclined surfaces 63J, the second inclined surfaces 63K, and the third inclined surfaces 63L which are brought into sliding contact with the curved surface 55A. This construction enables the tray main body 61 to be smoothly swung to the standing position.

When the tray cover 62 is positioned at the closed position, the curved surface 55A of the bypass cover 55 is engaged with the engaging portions 63H of the respective protrusions 63B to limit the pivotal movement of the tray cover 62. With this construction, the tray cover 62 is stably kept at the closed position. The protrusions 63B guide the upper portion of the sheet supported by the tray cover 62, along the direction in which the sheet is to be supplied. Thus, the sheet is stably supplied to the conveyance path 14 formed in the main unit 11.

The tray cover 62 is provided with the contact ribs 62X at the positions nearer to the second axis 62L than the center of gravity of the tray cover 62. The contact ribs 62X are brought into contact with the tray main body 61 when the tray cover 62 is swung to the closed position. Due to this contact between the contact ribs 62X and the tray main body 61, the moment directed frontward (toward the main unit 11) acts on the upper portion of the tray main body 61, and this moment is greater than the moment caused by the weight of the tray cover 62. This moment enables the tray main body 61 to be moved to the standing position more smoothly.

Modifications

The protrusions 63B (each as one example of the first member) of the respective guide members 63 provided on the tray cover 62 have the first inclined surfaces 63J, the second inclined surfaces 63K, and the third inclined surfaces 63L (each as one example of the first sliding contact surface). However, the present disclosure is not limited to this construction. For example, the first sliding contact surface may be constituted by two inclined surfaces, four or more inclined surfaces, or a surface curved in an arc shape.

The first inclined surfaces 63J, the second inclined surfaces 63K, and the third inclined surfaces 63L (each as one example of the first sliding contact surface) of the protrusions 63B (each as one example of the first member) and the curved surface 55A (as one example of the second sliding contact surface) of the bypass cover 55 (as one example of the second member) may be reversed. That is, the MFP 10 may be configured such that each of the protrusions 63B has a surface protruding in an arc shape, and the bypass cover 55 has a sliding contact surface with which the curved surface is brought into sliding contact. In this case, the sliding contact surface may be constituted by a plurality of inclined surfaces or a surface curved in an arc shape.

The curved surface 55A (as one example of the second sliding contact surface) with which the first inclined surfaces 63J, the second inclined surfaces 63K, and the third inclined surfaces 63L (each as one example of the first sliding contact surface) are brought into sliding contact may not be provided on the bypass cover 55 (as one example of the second member). The curved surface 55A at least needs to be provided on a second member disposed at a position at which the first sliding contact surface can be brought into sliding contact with the second member in the main unit 11.

In the above-described embodiment, the contact ribs 62X provided on the tray cover 62 are brought into contact with the respective protrusions 61P provided on the main unit 11.

However, each of the protrusions 61P provided on the main unit 11 may be provided with a contact portion contactable with the tray cover 62.

The MFP 10 may be configured such that the protrusions 63B of the respective guide members 63 provided on the tray cover 62 are not brought into sliding contact with the curved surface 55A of the upper end portion of the bypass cover 55. That is, the MFP 10 may be configured such that the tray main body 61 is swung to the standing position only by contact of each contact rib 62X (as one example of the contact portion) provided on the tray cover 62, with the corresponding protrusion 61P and the corresponding projection 61S provided on the upper portion of the corresponding tray side member 61B of the tray main body 61. In this case, for example, the center of gravity of the tray cover 62, and positions at which each contact rib 62X contacts the corresponding protrusion 61P and the corresponding projection 61S are set to stably swing the tray main body 61 to the standing position.

The contact ribs 62X (each as one example of the contact portion), and the protrusions 61P and the projections 61S provided on the upper portions of the tray side members 61B of the tray main body 61 may not be provided. That is, the tray main body 61 may be swung to the standing position only by sliding contact of the protrusions 63B of the guide members 63 provided on the tray cover 62, with the curved surface 55A of the upper end portion of the bypass cover 55.

What is claimed is:

1. A sheet conveying apparatus, comprising:

a main unit defining a conveyance path through which a sheet is to be conveyed;

a tray main body configured to support the sheet to be supplied to the conveyance path, the tray main body being pivotable between a standing position and an inclined position about a first axis relative to the main unit; and a tray cover connected to the tray main body and pivotable about a second axis parallel with the first axis, relative to the tray main body, between a bent position at which the tray cover is bent relative to the tray main body and a straight position at which the tray cover extends straight relative to the tray main body, wherein a space formed between the main unit and the tray main body is covered by the tray cover located at the bent position relative to the tray main body at the standing position and exposed by the tray cover located at the straight position relative to the tray main body at the inclined position, wherein the tray cover pivoting from the straight position to the bent position relative to the tray main body at the inclined position causes the tray main body to pivot from the inclined position to the standing position, whereby the tray cover covers the space, and wherein the tray cover comprises a first member configured to be located in the space when the tray cover covers the space, and the main unit comprises a second member, the first member being configured to, when the tray cover pivots from the straight position to the bent position relative to the tray main body at the inclined position, make a sliding contact with the second member by a weight of the tray cover, the sliding contact causing the tray main body to pivot from the inclined position to the standing position.

2. The sheet conveying apparatus according to claim 1, wherein the tray cover comprises a support surface that supports, together with the tray main body, the sheet when the tray cover is located at the straight position relative to the tray main body at the inclined position.

3. The sheet conveying apparatus according to claim 2, wherein the first member comprises a first sliding contact surface, wherein the second member comprises a second sliding contact surface, and wherein one of the first sliding contact surface and the second sliding contact surface is a curved surface protruding in an arc shape toward the other of the first sliding contact surface and the second sliding contact surface.

4. The sheet conveying apparatus according to claim 3, wherein an angle between a portion of the first sliding contact surface and the support surface decreases with decrease in distance between the portion of the first sliding contact surface and the second axis, and wherein the second sliding contact surface is the curved surface.

5. The sheet conveying apparatus according to claim 1, wherein the first member comprises an engaging portion configured to, when the tray cover covers the space, engage the second member to restrain pivotal movement of the tray main body from the standing position to the inclined position.

6. The sheet conveying apparatus according to claim 1, wherein the first member is configured to guide an edge of the sheet supported on the tray main body.

7. The sheet conveying apparatus according to claim 1, further comprising a contact portion provided on one of the tray cover and the tray main body, wherein the contact portion is configured to contact the other of the tray cover and the tray main body at a position nearer to the second axis than a center of gravity of the tray cover to generate a moment at an upper portion of the tray main body, and the moment is directed toward the main unit and is greater in magnitude than a moment generated due to a weight of the tray main body.

8. The sheet conveying apparatus according to claim 1, wherein the main unit comprises an image recorder configured to record an image on the sheet conveyed along the conveyance path.

9. The sheet conveying apparatus according to claim 8, further comprising:

a pivoting unit pivotable between a first position and a second position about a third axis parallel with the second axis; and an interlock mechanism configured to pivot the tray cover from the bent position to the straight position relative to the tray main body at the standing position in conjunction with pivotal movement of the pivoting unit from the first position to the second position.

* * * * *